United States Patent [19]

Imose et al.

[11] Patent Number: 4,568,274

[45] Date of Patent: Feb. 4, 1986

[54] HEAT TREATING FURNACE FOR METALLIC STRIP

[75] Inventors: Masayuki Imose, Kawanishi; Tadashi Yamamoto, Takarazuka; Masato Nagata, Ikoma, all of Japan

[73] Assignee: Chugai Ro Co., Ltd., Japan

[21] Appl. No.: 622,692

[22] Filed: Jun. 20, 1984

[30] Foreign Application Priority Data

Jun. 21, 1983 [JP] Japan ..... 58-112328

[51] Int. Cl.[4] ..... C21D 9/52; F27B 9/28; F27D 15/02

[52] U.S. Cl. ..... 432/59; 266/102; 432/82

[58] Field of Search ..... 432/8, 59, 82, 21; 266/102

[56] References Cited

U.S. PATENT DOCUMENTS

| | | | |
|---|---|---|---|
| 1,858,678 | 5/1932 | McVey et al. | 432/82 |
| 2,294,019 | 8/1942 | Boyle | 432/10 |
| 2,296,806 | 9/1942 | Buckholdt | 266/252 |
| 3,186,694 | 6/1965 | Beggs | 432/21 |
| 4,478,573 | 10/1984 | Kitayama et al. | 432/124 |
| 4,484,889 | 11/1984 | Marchal et al. | 432/59 |

FOREIGN PATENT DOCUMENTS 55-94442 7/1980 Japan .

*Primary Examiner*—John J. Camby

*Attorney, Agent, or Firm*—Jackson & Jones

[57] ABSTRACT

A heat treating furnace for a metallic strip, which includes a heat exchanging zone and a heating/soaking zone provided within a furnace body by dividing the furnace body with a partition wall disposed in a widthwise direction so as to transport the metallic strip in a confronting state through the heat exchanging zone. The heat exchanging zone is further provided with nozzles for jetting atmospheric gas of the heat exchanging zone onto opposite surfaces of the metallic strip being transported, an atmosphere supply duct for the nozzles, and a circulation fan so as to utilize sensible heat discharged or dissipated from the metallic strip during pre-cooling for pre-heating the metallic strip.

3 Claims, 4 Drawing Figures

HEAT TREATING FURNACE FOR METALLIC STRIP

BACKGROUND OF THE INVENTION

The present invention generally relates to a heat treating process and more particularly, to a heat treating furnace for heat-treating a metallic strip and the like therein.

Conventionally, in heat treating furnaces for a metallic strip, etc., heat treatment is effected by heating and soaking the metallic strip at a predetermined temperature and cooling the metallic strip thereafter. Heat discharged from the metallic strip during the cooling thereof is undesirably dissipated into the atmosphere without being utilized, thus resulting in a loss of energy to a large extent.

SUMMARY OF THE INVENTION

Accordingly, an essential object of the present invention is to provide an improved heat treating furnace for a metallic strip in which the heat discharged from the metallic strip into the atmosphere during cooling thereof is utilized as a pre-heating source of the material that is about to be treated for achieving an energy saving.

Another important object of the present invention is to provide a heat treating furnace of the above described type which is simple in construction and stable in functioning with high reliability.

In accomplishing these and other objects, according to one preferred embodiment of the present invention, there is provided a heat treating furnace for a metallic strip, which includes a furnace body, a heat exchanging zone for pre-heating and pre-cooling the metallic strip, and a heating/soaking zone for heating and soaking the metallic strip. The heat exchanging zone and heating-/soaking zone are provided within the furnace body by dividing the interior of the furnace body with a partition wall disposed in a direction across the width of the furnace body so as to permit the transoportation of the metallic strip in a cyclic arrangement through the heat exchanging zone. The heat exchanging zone is further provided with nozzle means for jetting atmospheric gas of the heat exchanging zone onto opposite surfaces of the metallic strip being transported, an atmosphere supply duct means for the nozzle means, and a circulation fan for utilizing the heat dissipated from the metallic strip during pre-cooling for pre-heating the metallic strip.

By the arrangement of the present invention as described above, an improved heat treating furnace has been advantageously provided through a simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
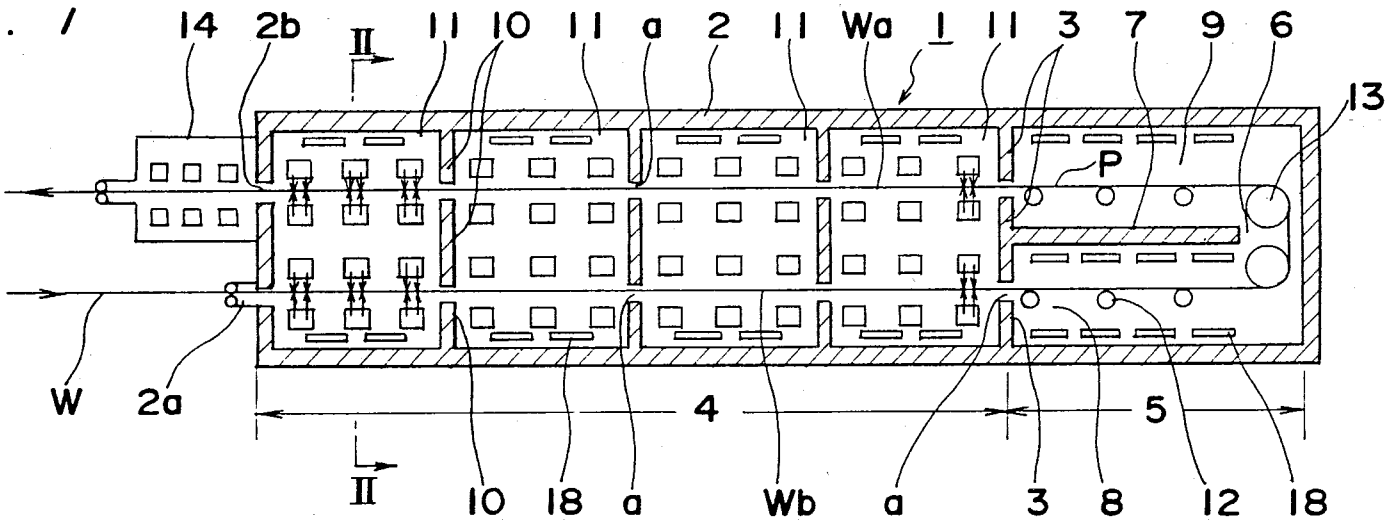
FIG. 1 is a schematic side sectional view of a heat treating furnace for a metallic strip according to one preferred embodiment of the present invention.

Before the description of the present invention proceeds, it is to be noted that like parts are designated by like reference numerals throughout the accompanying drawings.

Referring now to the drawings, there is shown in FIG. 1, a heat treating furnace 1 for heat treating a metallic strip according to one preferred embodiment of the present invention. The heat treating furnace 1 includes a housing or a furnace body 2 of a refractory material which is divided by a partition wall 3 provided in a direction across the width of the furnace 1, into a heat exchanging zone 4 for pre-heating the metallic strip W and also for cooling the metallic strip W after heating and soaking thereof, and a heating/soaking zone 5 for subjecting the metallic strip W to the heating and soaking. The heating/soaking zone 5 is divided into a heating chamber 8 and a soaking chamber 9 by a section wall 7 provided therein in the lengthwise direction of the furnace 1 except for a space 6 at the end portion thereof, while the heat exchanging zone 4 is further divided into a plurality of heat exchanging chambers 11 by corresponding section walls 10 provided therein in the widthwise direction of the furnace 1. It is to be noted, however, that the section walls 7 and 10 need not necessarily be provided.

The metallic strip W is transported in the direction indicated by an arrow through a U-shaped path P formed along a charge port 2*a*, openings "a" provided in the section walls 10 and the partition wall 3, support rollers 12 and direction changing rollers 13 rotatably provided in the heating/soaking zone 5, and a discharge port 2*b* of the furnace 1 so as to be subjected to the heat treatment by being pre-heated at the lower portion of the heat exchanging chambers 11, further being heated up to a predetermined temperature at the heating/soaking zone 5, and then, being pre-cooled at the upper portion of the heat exchanging chambers 11 before passing through a conventional cooling zone 14 provided subsequent to the discharge port 2*b*.

Figure 2:
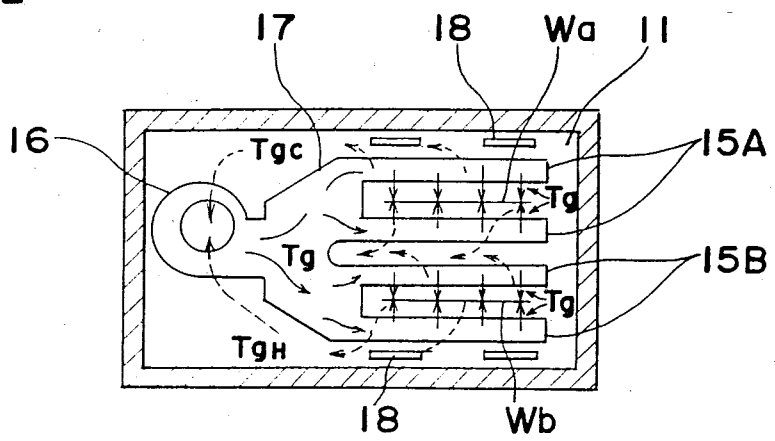
FIG. 2 is a cross section taken along the line II—II in FIG. 1.

Meanwhile, as shown in FIG. 2, each of the heat exchanging chambers 11 is provided therein with a pair of nozzles 15A and 15B disposed to surround the transport path P therebetween, and a common atmosphere supply duct 17 having a circulation fan 16, whereby the atmospheric gas in the heat exchanging chamber 11 is drawn by the circulation fan 16 for raising the pressure so as to be directed through the bifurcated nozzles 15A and 15B, onto both surfaces of the metallic strip W that is being transported for pre-heating or pre-cooling of the strip W and also for supporting the strip through a floating effect to provide translation support.

Subsequently, operations of the heat treating furnace having the construction as described so far will be explained hereinbelow.

In the first place, the metallic strip W is passed through the heat treating furnace 1 as shown in FIG. 1, and heaters 18 of the heat exchanging zone 4 and the heating/soaking zone 5, and the circulation fans 16 are operated so as to raise the temperature in the respective heat exchanging chambers 11 and the heating/soaking zone 5 up to a predetermined level. When the heat treating furnace 1 reaches a state in which it can be operated, the metallic strip W is continuously transported for effecting the heat treatment, while by ensuring a steady state of operation, the heaters 18 of the heat exchanging zone 4 are cut off.

It is to be noted here that, although the heaters 18 for the heat exchanging zone 4 are intended to rapidly raise the temperature therein up to a steady temperature capable of continuous operation, such heaters 18 need not necessarily be provided, but may be omitted depending on requirements.

The metallic strip W continuously fed within the heat treating furnace 1 is transported, through the heat exchanging zone 4, to the heating/soaking zone 5 so as to be heated and soaked at the predetermined temperature by the heaters 18, and again, introduced into the heat exchanging zone 4, where the portion Wa of the metallic strip W is heated up to a high temperature in the heating/soaking zone 5 and exchanges heat with the portion Wb thereof passing through the lower portion as described later for pre-heating the lower portion Wb, and also, for being pre-cooled itself.

Figure 3:
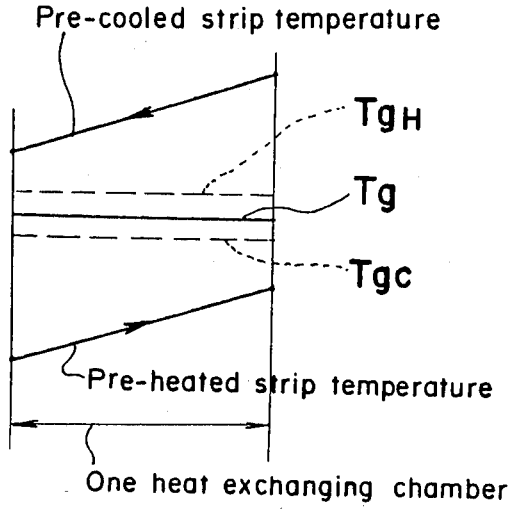
FIG. 3 is a diagram explanatory of principle for a heat exchanging function in a heat exchanging zone in the furnace of FIG. 1.
Figure 4:
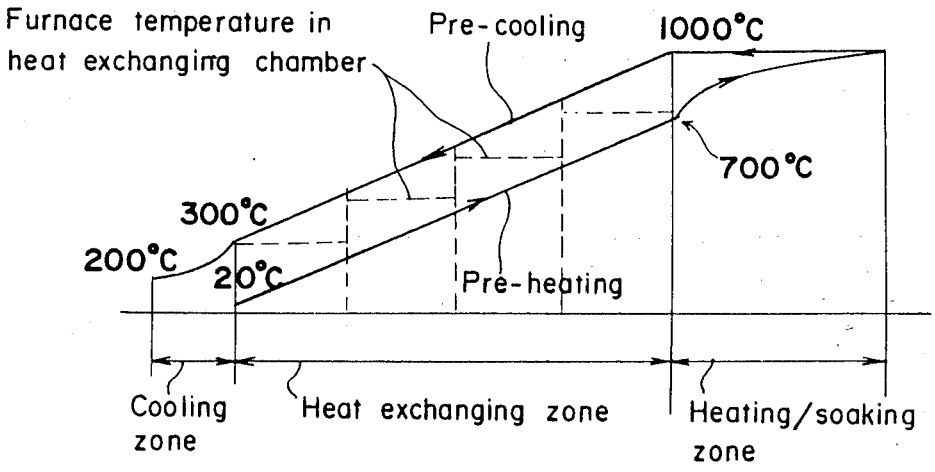
FIG. 4 is a diagram representing heat curves for the heat treating furnace of FIG. 1.

More specifically, referring also to FIGS. 3 and 4, the atmospheric gas at a temperature Tg in the heat exchanging chamber 11 is directed onto both surfaces of the portion Wa of the strip W at a high temperature from the upper pair of nozzles 15A by the circulation fan 16 through the duct 17 so as to absorb the reusable heat given off by portion Wa of the strip W, and thus, raises its temperature to TgH. Meanwhile, the atmospheric gas at a temperature Tg jetting from the lower pair of nozzles 15B imparts heat to the portion Wb of the strip W, and is lowered in its temperature to TgC. Thus, the atmospheric gases at the temperatures TgH and TgC subjected to heat exchange with respect to the metallic strip W as described above are drawn by the circulation fan 16 for mixing so as to become atmospheric gas at the temperature Tg to repeat the heat exchanging in the similar manner as disclosed in (FIG. 3). It is to be noted here that the heat exchanging function in the respective heat exchanging chambers 11 is exactly the same except that the atmospheric gas temperature Tg is gradually increased towards the side of the heating/soaking zone 5.

Accordingly, by way of example, a metallic strip W at a temperature of 20° C. charged into the heat treating furnace 1 from the charge port 2a thereof is heated and held at a temperature of 1000° C. in the heating/soaking zone 5 after having been slowly pre-heated up to a temperature of about 700° C. at the lower portion of the heat exchanging zone 4, and thereafter, gradually cooled down to 300° C. at the upper portion of the heat exchanging zone 4 so as to be introduced through the discharge port 2b into the conventional cooling zone 14 where said strip W is cooled to a temperature at 200° C. for being discharged subsequently. (FIG. 4).

It should be noted here that, in the foregoing embodiment, although the present invention has been mainly described with reference to a horizontal type heat treating furnace, the concept of the present invention is not limited in its application to such a horizontal type furnace alone, but may readily be applied to a vertical type heat treating furnace as well, and that the transport means within the furnace is not limited to that as employed in the above embodiment, but may be modified to a floater system, roller system, catenary system or a combination thereof over the entire zone. Moreover, the heating system in the heating/soaking zone 5 may of course be radiation heating or convection heating depending on necessity. Meanwhile, the heat exchanging zone 4 need not necessarily be divided into the plurality of heat exchanging chambers 11 as in the above embodiment.

As is clear from the foregoing description, according to the present invention, since the heat source for preheating the metallic strip is obtained by the heat amount dissipated from the metallic strip at a high temperature coming out of the heating/soaking zone, without requiring any external heat energy, the fuel unit of $25\times10^4$ Kcal/Ton at a furnace efficiency of 70% in the conventional arrangements is reduced only to $12.8\times10^4$ Kcal/Ton, with an improvement of the furnace efficiency up to 140%. Moreover, the amount of cooling water conventionally employed in the cooling zone may be decreased to a large extent.

Furthermore, owing to the structure that the heat exchanging zone is in the same space as that for the cooling zone and pre-heating zone, heat exchange due to radiation between the upper and lower portions of the metallic strip functions to improve the heat exchanging efficiency, and since only one circulation fan is sufficient for the convection heat exchange, the construction is simplified by that extent, thus resulting in a reduction of cost of the heat treating furnace on the whole.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An improved heat treating furnace for treating elongated flexible metallic strips and for conservation of energy comprising:

an elongated housing having a plurality of partition walls, each partition wall having at least a pair of openings;

means for transporting metallic strip into and out of the housing and through the openings including a series of rollers and at least a pair of bifurcated nozzles;

means for heating the gases in the furnace;

means for mixing the gases subject to heating by the exiting metallic strip and the gases subject to cooling by the entering metallic strip, and means for providing the mixed gases at an intermediate temperature to the bifurcated nozzles, the bifuracted nozzles extend about the metallic strip and direct gases toward the upper and lower portion of the translating metallic strip for effectuating a heat transfer and a translational support of the metallic strip.

2. A continuous heat treating furnace for a metallic strip arranged to utilize heat discharged during a precooling period of the metallic strip for preheating thereof, said furnace comprising:

a furnace body having a plurality of partition walls at one side end wall thereof, with a pair of metallic strip passing openings;

a partition wall provided across the width of said furance body for dividing the interior of the furnace body in a longitudinal direction thereof into a heating/soaking zone and a heat exchanging zone, said partition wall having a corresponding pair of metallic strip passing openings;

said heating/soaking zone including means for heating and soaking the metallic strip to a predetermined temperature, said heating/soaking zone being provided with a heating means and a metallic strip inverting means; and said heat exchanging zone for effecting precooling and preheating of the metallic strip, said heat exchanging zone being divided into a plurality of chambers by section walls each formed with a pair of metallic strip passing openings, with the respective chambers having means for jetting atmospheric gas within said chambers onto opposite surfaces of the metallic strips as said strips are cyclically transported through said furnace, said metallic strips being carried into said heating/soaking zone through one side of said metallic strip passing openings and inverted by the inverting means located within the heating/soaking zone so as to be further transported through the other side of said metallic strip passing openings.

3. A continuous heat treating furnace as claimed in claim 2, wherein said atmospheric gas jetting means located within said respective chambers includes:

a bifurcated nozzle means for supporting the entering metallic strip therebetween and another bifurcated nozzle means for supporting the exiting metallic strip therebetween, a common duct connecting said respective nozzle means together, and a fan for supplying the atmospheric gas within the chambers into said duct.

* * * * *